US005793165A

United States Patent [19]

Hayashi et al.

[11] Patent Number: 5,793,165

[45] Date of Patent: Aug. 11, 1998

[54] DEFLECTION YOKE FOR USE IN ELECTRON-BEAM TUBES OF TELEVISION RECEIVERS WITH RAPID MAGNETIC FIELD CHANGE ELIMINATION

[75] Inventors: Yoshihisa Hayashi, Yokohama; Kouichi Yamasaki, Miyagi-ken, both of Japan

[73] Assignee: Murata Manufacturing Co. Ltd., Kyoto-fu, Japan

[21] Appl. No.: 659,643

[22] Filed: Jun. 6, 1996

[30] Foreign Application Priority Data

Jun. 7, 1995 [JP] Japan ..... 7-164815

[51] Int. Cl.[6] ..... H01J 29/56

[52] U.S. Cl. ..... 315/370; 315/371

[58] Field of Search ..... 315/370, 371; 348/806

[56] References Cited

U.S. PATENT DOCUMENTS

| | | | |
|---|---|---|---|
| 3,803,444 | 4/1974 | Gerritsen et al. . | |
| 4,547,707 | 10/1985 | Yabase . | |
| 5,079,486 | 1/1992 | Honda et al. | 315/371 |
| 5,177,412 | 1/1993 | Morohashi et al. | 315/370 |

FOREIGN PATENT DOCUMENTS

1225045 A 9/1989 Japan .

4286841 A 10/1992 Japan .

*Primary Examiner*—Theodore M. Blum

*Attorney, Agent, or Firm*—Graham & James LLP

[57] ABSTRACT

A deflection yoke device for use in three-gun color picture tube of television receivers includes a pair of vertical deflection coils which are divided into barrel magnetic field production coil sections and pincushion magnetic field production coil sections. The yoke also includes a varistor that controls the flow of current for corrections of cross-misconvergence PQV and misconvergence S3V while suppressing or eliminating white rasters. More specifically, the pair of vertical deflection coils are subdivided into a series circuit of two barrel magnetic field production coil sections and another series circuit of two pincushion magnetic field production coil sections to which the varistor is connected. The varistor produces a barrel magnetic field in the center region of a display screen where vertical deflection current remains relatively small, while allowing a pincushion magnetic field to be created in the upper and lower peripheral sections thereof where the vertical deflection current increases. This eliminates rapid switching of the nature of the vertical magnetic field in nature from the barrel magnetic field to the pincushion magnetic field so that white rasters will no longer be generated on the screen.

5 Claims, 10 Drawing Sheets

DEFLECTION YOKE FOR USE IN ELECTRON-BEAM TUBES OF TELEVISION RECEIVERS WITH RAPID MAGNETIC FIELD CHANGE ELIMINATION

BACKGROUND OF THE INVENTION

1. Field of the Invention

The present invention relates generally to television systems, and more particularly to deflection yoke devices for use in three-gun color picture tubes of television receivers.

2. Description of Related Art

Electron-beam tubes are becoming more widely used in the manufacture of television receivers and video monitor display units. Electron-beam tubes include a three-gun color picture tube, which may be a cathode-ray tube having a line of three primary-color electron guns to provide a so-called "inline" electron gun module. Generally, a deflection yoke device that comprises an assembly of one or more electromagnets is placed at or around the neck of the color picture tube for producing a magnetic field for deflection of electron beams emitted from the inline electron guns. In such a three-gun color picture tube, the horizontal deflection magnetic field is usually a pincushion magnetic field whereas the vertical deflection magnetic field is a barrel magnetic field. With such deflection magnetic fields, the horizontal deflection magnetic field, for example, tends to enhance the nature of the pincushion magnetic field as it moves away from the center region of a display screen of the color picture tube. Therefore, the right-and left-side electron beams located far from the center of screen will be vertically deflected more strongly than those in the center.

This results in deviations of red (R) and blue (B) components in the upper and lower peripheral regions of the screen as shown in FIG. 6, causing cross-misconvergence PQV to take place. Simultaneously, as shown in FIG. 7, misconvergence S3V may possibly occur causing the R and B components to deviate at intermediate points of the Y axis direction relative to the X axis direction of the screen. Appearance of such misconvergences serves as a bar to achievement of high quality pictures. This problem becomes more serious especially when applied to advanced cathode-ray tubes for use in the monitoring devices, display devices and the like, which have more strict requirements for elimination of misconvergences.

One approach to attain a deflection yoke capable of correcting such misconvergences has been disclosed, for example, in Published Unexamined Japanese Patent Application (PUJPA) 1-225045. Another known deflection yoke has been described in PUJPA 4-286841.

The prior art deflection yoke is placed around the neck portion of an inline electron-gun cathode-ray tube, and is arranged in such a manner that it is divided into two coil sections by use of an intermediate tap as taken from a certain midway portion of a vertical deflection coil used therein. One of the coil sections is connected in series to two diodes, which diodes are connected in parallel to each other such that the polarity of the diodes is reversed.

A detailed arrangement of the prior art deflection yoke will be described with reference to FIGS. 8 to 12. This prior art assumes the use of the "saddle-saddle" (SS) type deflection yoke having horizontal and vertical deflection coils each consisting of a saddle-like coil.

As shown in FIG. 8, a coil bobbin 1 is adapted for retaining each pair of deflection coils described later while maintaining electrical insulation therebetween. The coil bobbin 1 essentially consists of a cone-like cylinder section 1A having a gradually increased diameter, front- and rear-side flange sections 1B, 1C arranged at the front and rear ends of the cone-like cylinder 1A, respectively with each section 1B, 1C extending diametrically, and a rear-side clamp member 1D arranged in the back of the rear flange 1C, all of which are integrally molded using a known resin-material.

A pair of saddle-like horizontal deflection coils 2 are mounted in the coil bobbin 1 in such a way that the coils 2 are located at upper and lower positions along the inner peripheral surface of the coil bobbin 1. Each horizontal deflection coil 2 consists of a base 2A disposed along the inner peripheral surface of the cone-like cylinder 1A of the coil bobbin 1, a front-end connecting wire section 2B packed in the front-side flange 1B, and a rear-end connecting wire section 2C in the rear-side flange 1C. These are turned to define an overall saddle shape which causes the horizontal deflection magnetic field produced inside the coil bobbin 1 to be a pincushion magnetic field.

A pair of saddle-like vertical deflection coils 3 are also associated with the coil bobbin 1 so that they are located on the right and left sides along the outer peripheral surface thereof. Each coil 3 comprises a base 3A disposed on the outer peripheral surface of the cone-like cylinder 1A of the coil bobbin 1, a front-end connecting wire section 3B located in the back of the front-side flange 1B, and a rear-end connecting wire section 3C in front of the rear-side flange 1C. The elements 3A–3C of the coils 3 form an overall saddle shape which allows a vertical deflection magnetic field to be created inside the coil bobbin 1.

Lead wires 4R, 4L extend out of certain midway portions of windings turned around the vertical deflection coils 3. One lead wire 4R connected to the right-side vertical deflection coil 3 serves to divide the coil 3 into a barrel magnetic field production coil section 5 and a pincushion magnetic field production coil section 6 shown in FIG. 9. The other lead wire 4L coupled to the left-side vertical deflection coil 3 divides the coil 3 into a barrel magnetic field production coil section 7 and a pincushion magnetic field production coil section 8.

A cross-sectional view of the barrel and pincushion magnetic field production coil sections 5, 6 formed by the right-side vertical deflection coil 3 is shown in FIG. 9, wherein the barrel magnetic field production coil section 5 may correspond to a part of the windings which extends from the terminal end (not shown) of the horizontal axis-side windings of the right-side vertical deflection coil 3 up to the lead wire 4R. As shown in FIG. 9, this part of the windings consists of a winding section 5A located at the upper right portion, and a winding section 5B located at the lower right portion. On the other hand, the pincushion magnetic field production coil section 6 corresponds to a part of winding that extends from the lead wire 4R of the right-side vertical deflection coil 3 to the terminal end of vertical axis-side windings, which part comprises a winding section 6A located at the upper right portion and a winding section 6B located at the lower right portion.

The remaining pair of barrel and pincushion magnetic field production coil sections 7, 8 formed by the left-side vertical deflection coil 3 are also shown in FIG. 9. The barrel magnetic field production coil section 7 may correspond to a part of the windings which extends from the terminal end (not shown) of the horizontal axis-side windings of the left-side vertical deflection coil 3 up to the lead wire 4L; as shown in FIG. 9, this part consists of a winding section 7A located at the upper left portion, and a winding section 7B located at the lower left portion. The pincushion magnetic field production coil section 8 corresponds to another part of the winding that extends from the lead wire 4L of the left-side vertical deflection coil 3 to the terminal end of vertical axis-side windings, which part consists of a winding section 8A located at the upper left portion and a winding section 8B located at the lower left portion.

When vertical deflection current is supplied to the barrel magnetic field production coil sections 5, 7, a barrel magnetic field is then produced inside the coil bobbin 1. Supplying vertical deflection current to the pincushion magnetic field production coil sections 6, 8 creates a pincushion magnetic field in the coil bobbin 1.

An annular core 9 is located the outer periphery of the vertical deflection coils 3 and is clamped between the front- and rear-end connecting wire sections 3B, 3C.

The deflection yoke thus arranged is tightly secured around the neck portion (not shown) of an associated cathode-ray tube, by rigidly clamping the rear clamp member 1D using a clamping band 10 after insertion of the neck portion into the coil bobbin 1.

Electrical circuitry of the resulting vertical deflection coils 3 with respective coil sections 5–8 is illustrated in FIG. 10, wherein the right-side barrel magnetic field production coil section 5 and the left-side barrel magnetic field production coil section 7 are connected in series to each other to provide a first series circuit, whereas the right-and left-side pincushion magnetic field production coil sections 6, 8 are also connected in series to define a second series circuit. The first series circuit is connected in parallel with the second series circuit. The parallel combination of the first and second series circuits is connected to a high-voltage terminal (Hot) and a low-voltage terminal (Cold), which are in turn connected to a known vertical deflection current generator circuit.

As shown in FIG. 10, two diodes 13, 14 are arranged so that they are disposed between the second series circuit 12 and the low-voltage terminal with the polarity of the diodes 13, 14 being reversed in phase relative to each other. These diodes 13, 14 may exhibit specific switching operations, the current-to-voltage characteristic of which is shown in FIG. 11, wherein each diode turns on when the applied voltage is greater in potential than the turn-on voltage VON. With such switching characteristic, the diodes 13, 14 are rendered nonconductive (turned off) in a certain display region 1 of FIG. 12 where the vertical deflection current remains relatively small, allowing the flow of current in the first series circuit 11 (barrel magnetic field production coil sections 5, 7) to control the operation of the deflection yoke. Alternatively, in the remaining, upper and lower peripheral display regions 2 of FIG. 12, the diodes 13, 14 are rendered conductive (turned on) causing the flow of current in the second series circuit 12 (pincushion magnetic field production coil sections 6, 8) to control the operation.

Turning to FIG. 10, the barrel magnetic field production coil sections 5, 7 are associated with resistors 15, which are connected in parallel to a respective one of the coil sections. Similarly, the pincushion magnetic field production coil sections 6, 8 are connected in parallel to a respective one of the resistors 16. A respective one of the resistors 15, 16 functions to eliminate the occurrence of ringing at the coil sections 5–8.

An adjustment resistor 17 is disposed between the resistors 15 with its tap being connected to a common node between the barrel magnetic field production coil sections 5, 7. Adjustment of the resistance of this resistor 17 may adjust the actual flow of current in the barrel magnetic field production coil sections 5, 7 while enabling the right- and left-side barrel magnetic fields to be adjusted and balanced relative to each other.

A diode-control resistor 18 is connected in parallel to the diodes 13, 14 for changing the relatively fast turn-on characteristic thereof to a more moderate characteristic by diverting the flow of current through diodes 13, 14. A sensitivity adjustment resistor 19 is connected between the first series circuit 11 and the low-voltage terminal, for adjusting the value of current flowing in a parallel circuit consisting of the first series circuit 11 and the resistors 15, 17 thereby to adjust the vertical deflection currents flowing through the first series circuit 11 and the second series circuit 12. Note here that the vertical deflection current I may be represented by I=I1+I2, where I1 is the current flowing in the first series circuit 11, and I2 is the current flowing in the second series circuit 12 under the assumption that resistance values of the resistors 15–18 are negligible for convenience of explanation only.

The prior art deflection yoke is placed around the neck of an inline three-gun color picture tube of television receivers having a liner array of three primary-color (R, G, B) electron guns being inline-arranged in the horizontal direction. Supplying horizontal deflection current to the horizontal deflection coils 2 while providing the vertical deflection coils 3 with the vertical deflection current I that varies exponentially may cause respective coils to produce horizontal and vertical deflection magnetic fields. The magnetic fields produced are then used to deflect respective color electron beams derived from the three electron guns.

In the prior art deflection yoke, due to the switching operations of the two diodes 13, 14, when the vertical deflection current I is relatively small, that is, while the electron beams are scanning the display region 1 shown in FIG. 12, the current I2 is prevented from flowing into the second series circuit 12 (pincushion magnetic field production coil sections 6, 8) while allowing the current I1 to flow in the first series circuit 11 (barrel magnetic field production coil sections 5, 7) only. This results in the vertical deflection magnetic field being enhanced in barrel distortion thus enabling correction of the misconvergence S3V shown in FIG. 7.

Alternatively, when the vertical deflection current I increases, that is, when the electron beams are scanning the upper and lower peripheral display regions 2 of FIG. 12, the switching operations of the diodes 13, 14 may allow the current I2 to flow in the second series circuit 12 (pincushion magnetic field production coil sections 6, 8) also, causing the pincushion magnetic field production coil sections 6, 8 to produce a pincushion magnetic field. This serves to enhance the pincushion distortion of the vertical deflection magnetic field, thereby correcting the cross-misconvergence PQV of FIG. 6.

With such an arrangement, it becomes possible, by changing the distortion ratio of the vertical deflection magnetic field between the central region 1 and upper and lower peripheral regions 2 of the display screen, to correct the misconvergence S3V and cross-misconvergence PQV independently of each other, which may lead to producing high quality color pictures free from misconvergences on the screen.

A significant problem with the prior art deflection yoke is that rapid switching of the vertical deflection magnetic field from the barrel magnetic field to the pincushion magnetic field may possibly take place causing undesired white line(s) to appear at border lines of the display regions 1 and 2 shown in FIG. 12 due to the occurrence of so-called "white-rasters." More specifically, while the prior art deflection yoke employs the parallel combination of two diodes 13, 14 which operate depending upon the magnitude of the vertical deflection current I, each diode exhibits a relatively fast turn-on characteristic when the applied voltage exceeds its turn-on voltage $V_{ON}$ as seen from the diode characteristic shown in FIG. 11. To compensate for such a fast turn-on diode characteristic, it is required that the prior art additionally use the diode control resistor 18, which is connected in parallel to the diodes 13, 14.

Unfortunately, rendering moderate or reducing the relatively fast turn-on characteristic of the diodes 13, 14 is not achieved without accompanying problems: it requires the use of a relatively large resistance value for the diode control resistor 18. However, if the diode control resistor 18 has a large resistance value, the current I2 flowing in the second series circuit 12 (pincushion magnetic field production coil sections 6, 8) which is connected in series to diodes 13, 14 will also be decreased causing the vertical deflection magnetic fields produced by the vertical deflection coils 3 to become weaker. Due to such a trade-off problem, the resistance of the diode control resistor 18 cannot be unconditionally increased as required. Thus, there are strict limitations on increasing the resistance value of resistor 18.

Accordingly, the diodes 13, 14 must have a relatively sharp or fast turn-on switching characteristic. As a result, when the diodes 13, 14 perform turn-on switching operations as the vertical deflection current increases, the resulting current rushes to flow into the pincushion magnetic field production coil sections 6, 8, forcing the vertical deflection magnetic field to rapidly switch in nature from the barrel magnetic field to the pincushion magnetic field. Due to such rapid switching, unwanted white lines (known as "white rasters") can occur at the border lines between the display regions 1, 2 of FIG. 12. These white lines define transition lines of the vertical deflection magnetic field between the barrel and pincushion magnetic fields.

SUMMARY OF THE INVENTION

To solve the problems of the prior art devices described above, the preferred embodiments of the present invention provide a new and improved deflection yoke device.

More specifically, the preferred embodiments of the present invention provide an improved deflection yoke device capable of producing high quality pictures by use of a rapid barrel-to-pincushion magnetic-field change elimination scheme.

The preferred embodiments of the present invention also provide an improved deflection yoke device capable of enhancing the quality of color picture images of electron-beam tubes by correcting cross-misconvergence PQV and misconvergence S3V while suppressing or eliminating white rasters.

The deflection yoke device in accordance with the preferred embodiments of the present invention includes a coil bobbin located at or around the neck of a color picture tube of television receivers, and a combination of a horizontal deflection coil pair and a vertical deflection coil pair which are arranged in the coil bobbin for producing magnetic fields for deflection of one or more electron beams derived from the neck of color picture tube.

To overcome the problems with prior art devices, a significant structural feature of the deflection yoke according to the preferred embodiments of the present invention is that the vertical deflection coil pair is divided into at least two barrel magnetic field production coil sections and at least two pincushion magnetic field production coil sections. The barrel magnetic field production coil sections are connected in series to each other to provide one or a first series circuit, whereas the pincushion magnetic field production coil sections are connected in series to each other to define another or second series circuit. The first series circuit is connected in parallel with the second series circuit. A voltage-dependent variable resistor or "varistor" is specifically arranged so that the varistor is connected in series to either one of the first and second series circuits.

With such an arrangement, since the varistor preferably comprises a semiconductor device that may vary in resistance with potential variations of a voltage applied thereto, the varistor has a specific characteristic of enabling current to flow therein with nonlinearity being exhibited with respect to the applied voltage. Due to such "voltage-dependent nonlinearity" of current, the varistor thus enables the vertical deflection magnetic field produced by each vertical deflection coil to gradually switch in nature or transform from the barrel magnetic field into the pincushion magnetic field while eliminating its rapid switching therebetween.

Consider the case where the varistor is connected in series to the second series circuit, for instance. In this case, while the vertical deflection current remains relatively small, the varistor hardly permits the flow of current while allowing the vertical deflection current to flow exclusively in the first series circuit consisting of series-connected barrel magnetic field production coil sections, whereby the resulting vertical deflection magnetic field becomes equivalent in nature to the barrel magnetic field. Alternatively, when the vertical deflection current is gradually increased, the varistor now allows a current corresponding to the vertical deflection current to begin flowing in the second series circuit also, whereby the vertical deflection current flows also into the second series circuit consisting of the series-connected pincushion magnetic field production coil sections so that the vertical deflection magnetic field can be accurately controlled to gradually change from the barrel to the pincushion magnetic field. This enables the vertical deflection magnetic field created on the display screen to behave as the barrel magnetic field in the center region thereof, while allowing the nature of the pincushion magnetic field to be enhanced as it expands to approach the upper and lower peripheral display regions. It is thus possible to suppress the cross-misconvergence PQV and misconvergence S3V and, simultaneously, to eliminate white rasters which occur in prior art devices because of the use of diodes, thereby ensuring that high quality pictures can be obtained on the screen.

These and other elements, features and advantages of the preferred embodiments of the present invention will be apparent from the following more particular description of preferred embodiments of the invention, as illustrated in the accompanying drawings.

DETAILED DESCRIPTION OF THE INVENTION

Figure 1:
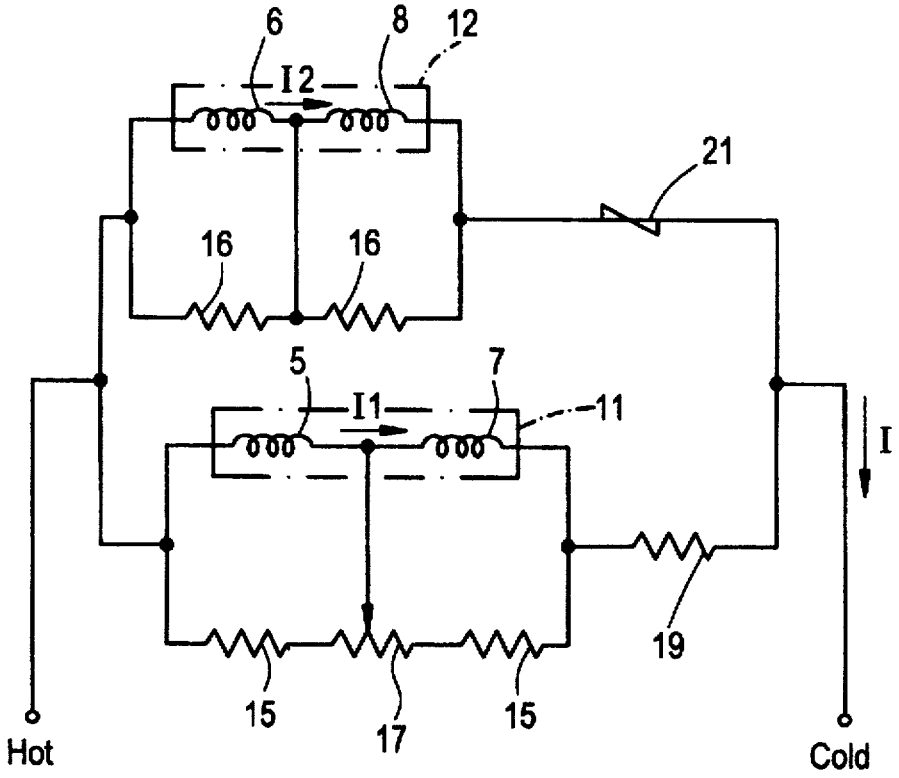
FIG. 1 is a circuit diagram of a deflection yoke device in accordance with one preferred embodiment of the present invention, including the interconnection of vertical deflection coils employed therein.

Several illustrative, preferred embodiments of the present invention will be described with reference to FIGS. 1 to 5, wherein like reference characters are used to designate the corresponding parts or components in the prior art shown in FIGS. 8–12, and detailed explanation thereof will be omitted herein for elimination of redundancy.

Figure 2:
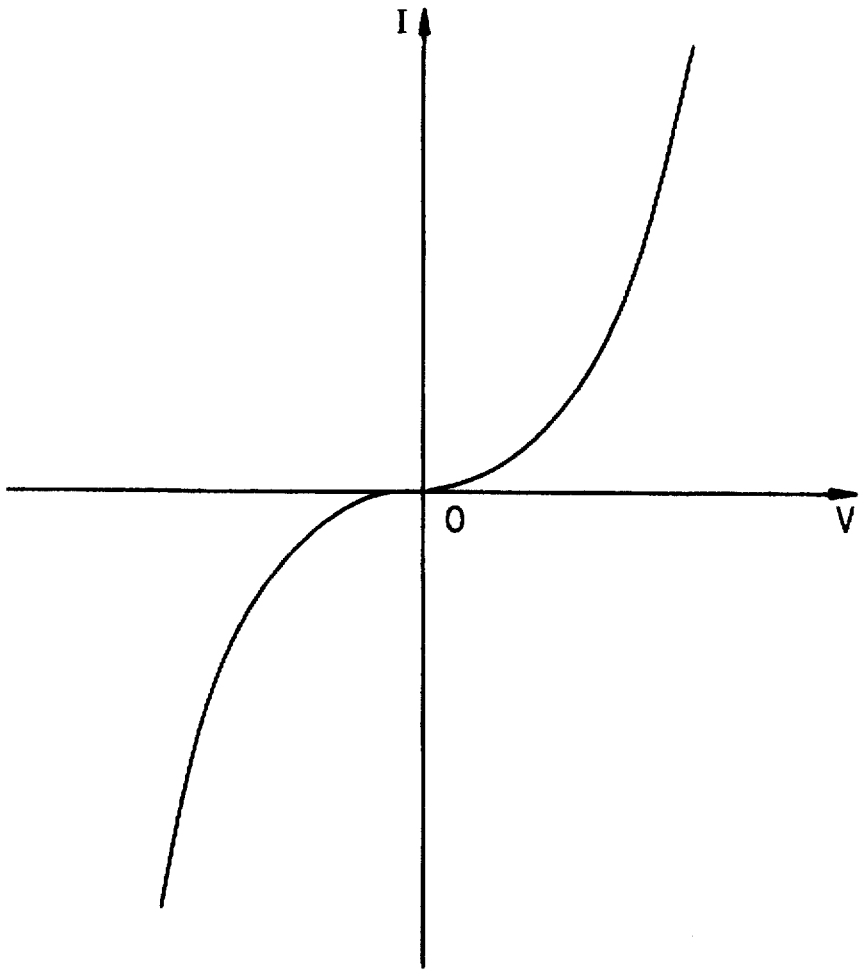
FIG. 2 illustrates a current-to-voltage characteristic of a varistor as adapted in the deflection yoke of FIG. 1.

Referring to FIGS. 1–2, a deflection yoke device in accordance with a first preferred embodiment of the invention employs a voltage-dependent variable resistor or "varistor" 21 in place of the two diodes 13, 14 in the prior art. The varistor 21 is connected between the second series circuit 12 of the pincushion magnetic field production coil sections 6, 8 and the low-voltage terminal of the deflection yoke. The varistor 21 preferably comprises a semiconductor device that may vary in resistance with potential variations of a voltage applied thereto. The varistor 21 may inherently exhibit a specific operating characteristic: it allows current to flow therein with nonlinearity being exhibited relative to the applied voltage. More specifically, it can be seen from just viewing the current-to-voltage characteristic of FIG. 2 that as the applied voltage positively increases in potential in the positive region thereof, the value of current flowing in the varistor 21 increases accordingly; in the negative region, as the applied voltage negatively increase, the current value negatively increases also.

The deflection yoke according to the preferred embodiments of the present invention is generally similar in operation to the prior art as described previously: the yoke is placed around the neck of an inline three-gun color picture tube of television receivers having a liner array of three primary-color (R, G, B) electron guns being inline-arranged in the horizontal direction. Supplying horizontal deflection current to the horizontal deflection coils 2 while providing the vertical deflection coils 3 with the vertical deflection current that varies exponentially may cause these coils to produce horizontal and vertical deflection magnetic fields. The magnetic fields produced are then used to deflect respective color electron beams emitted from the three electron guns so that these beams appropriately scan and excite three different colors of phosphors on the display screen to obtain a desired color picture image thereon.

A distinguishing feature of the deflection yoke of the first preferred embodiment lies in its unique operations as follows. Assume that the resistance values of respective resistors 15–19 are negligible for convenience of explanation only. The vertical deflection current I may be defined as $I=I1+I2$, where I1 is the current flowing in the first series circuit 11, and I2 is the current in the second series circuit 12.

Here, the varistor 21 serves to allow the current I2 flowing in the second series circuit 12 to be determined based on the current-to-voltage characteristic of FIG. 2, depending upon the actual magnitude of the vertical deflection current I. In the case where the current I2 flows in the second series circuit 12, a specific current Il ($I1=I-I2$) flows into the first series circuit 11. This enables the vertical deflection magnetic field produced by each of the vertical deflection coils 3 to cause a ratio of the barrel and pincushion magnetic fields to be equivalent in value to the ratio of the current I2 and current I1.

Figure 7:
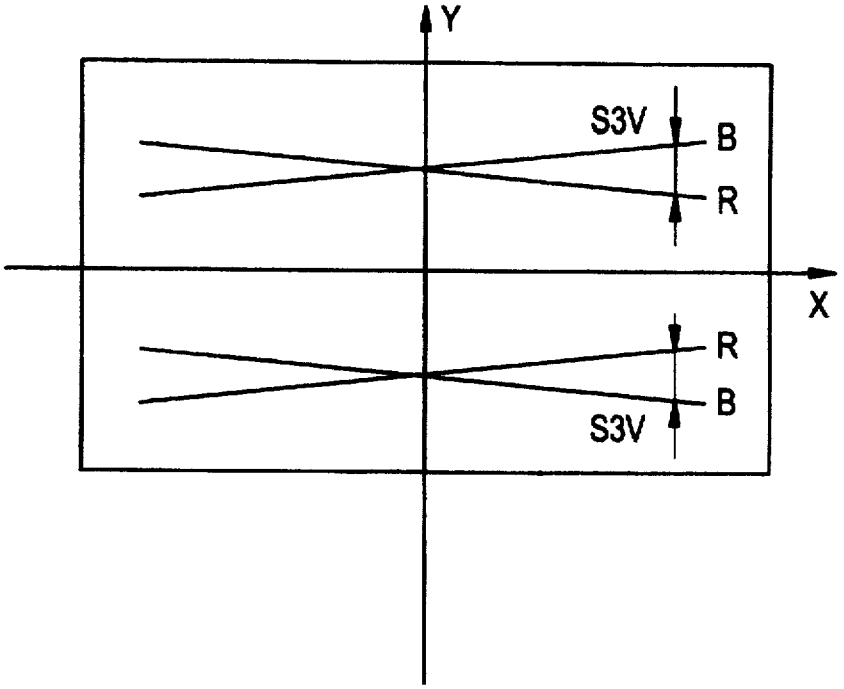
FIG. 7 illustrates a pattern of misconvergence S3V on the display screen.
Figure 8:
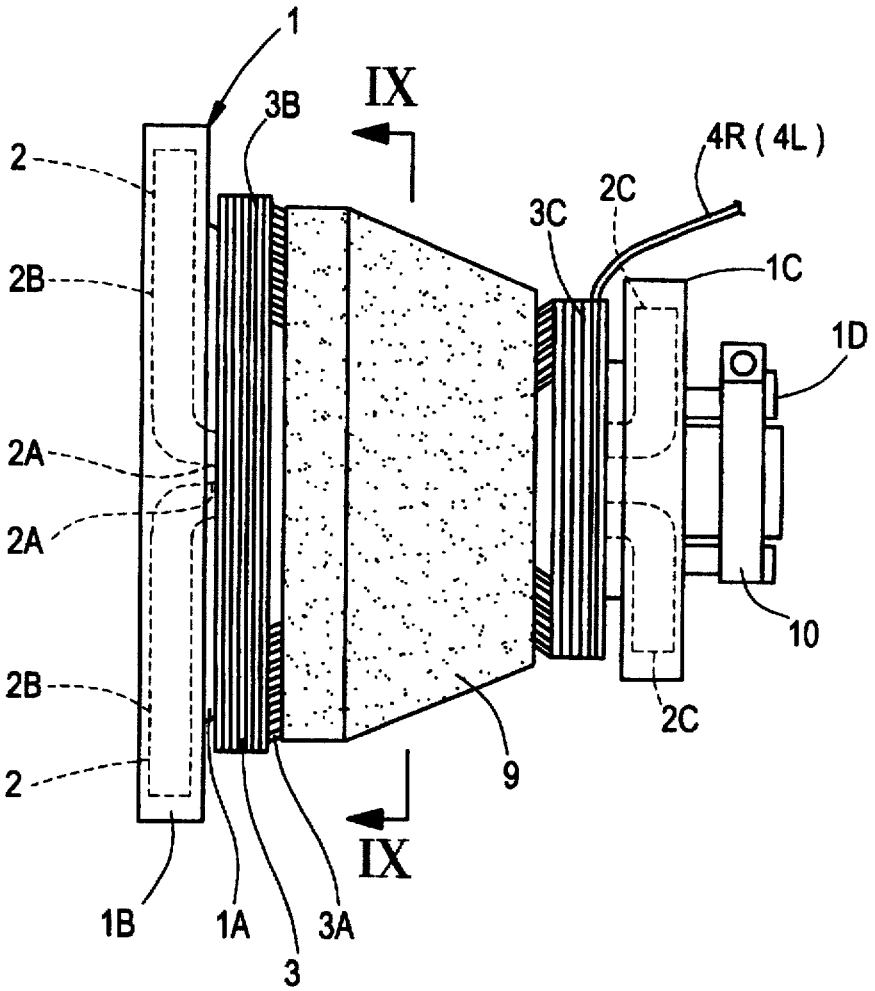
FIG. 8 PRIOR ART
FIG. 8 depicts a side view of a prior art saddle-saddle type deflection yoke.
Figure 9:
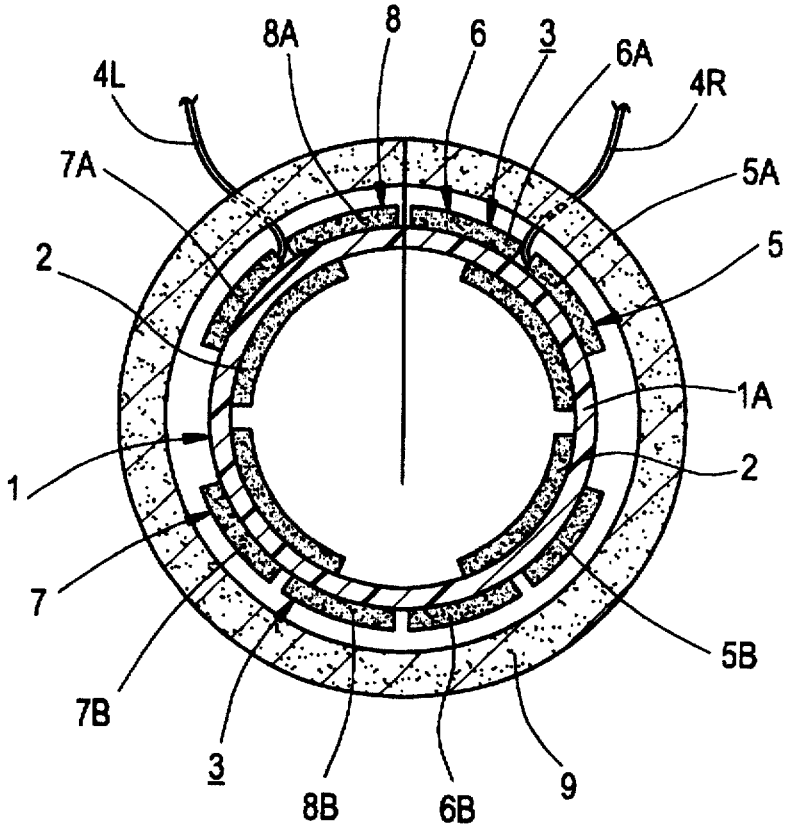
FIG. 9 PRIOR ART
FIG. 9 shows a cross-sectional structure of the prior art deflection yoke taken at line IX—IX of FIG. 8.
Figure 10:
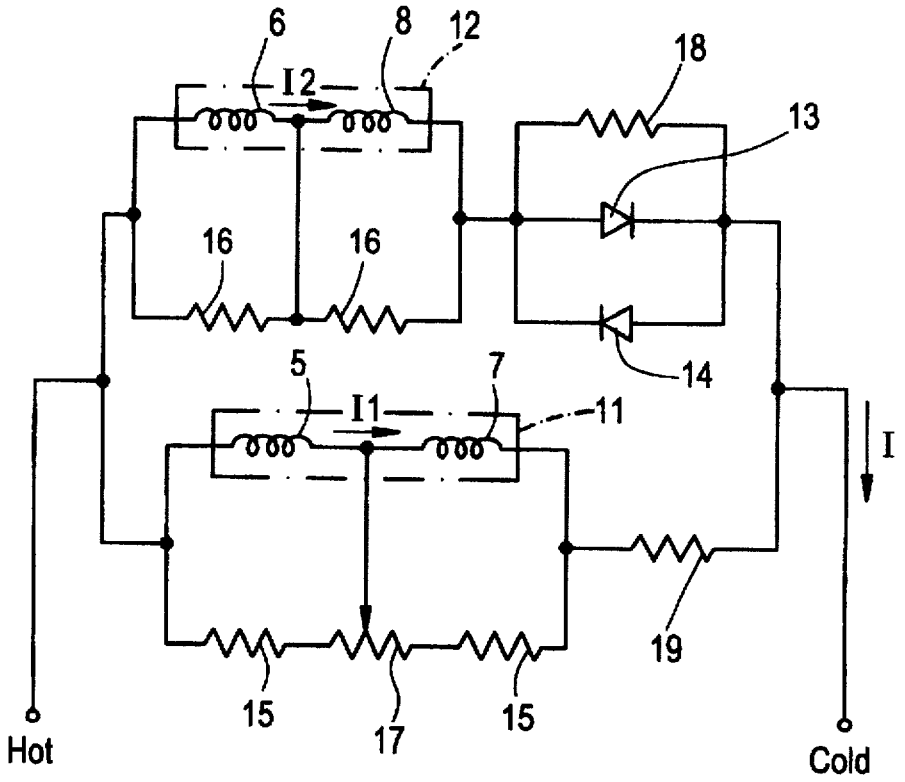
FIG. 10 PRIOR ART
FIG. 10 is a circuit configuration of the prior art deflection yoke, showing the interconnection of vertical deflection coils used therein.
Figure 11:
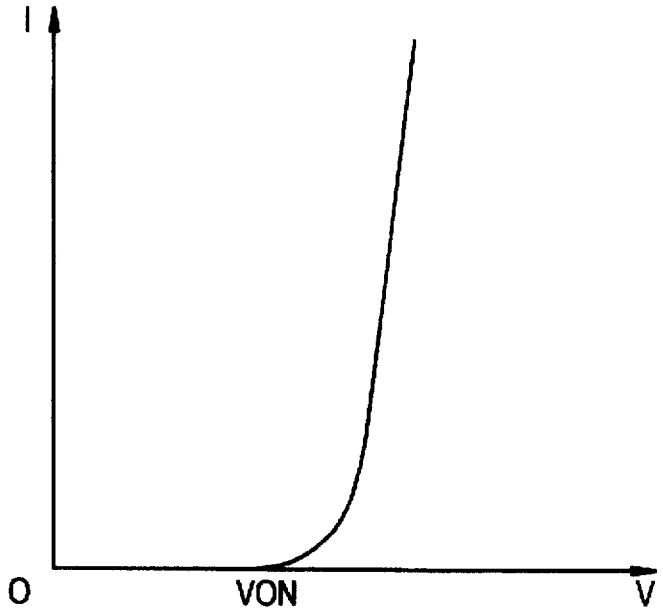
FIG. 11 PRIOR ART
FIG. 11 shows a current-to-voltage characteristic of a diode employed in the prior art deflection yoke.
Figure 12:
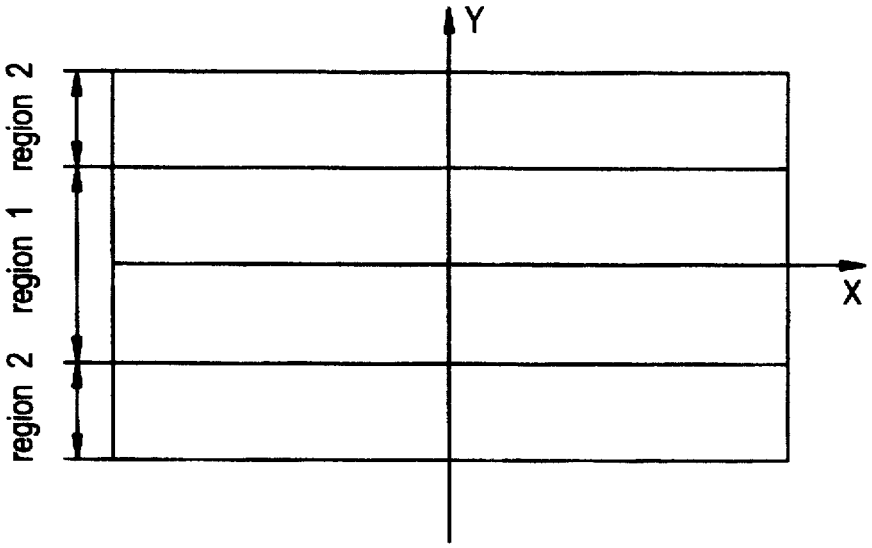
FIG. 12 PRIOR ART
FIG. 12 diagrammatically illustrates several regions of a display screen in which a vertical deflection magnetic field switches from the barrel magnetic field to the pincushion magnetic field.

First consider the case where the exponentially variable vertical deflection current I is relatively small, that is, the electron beams are scanning the center region of the display screen in the vertical direction thereof. In this case, the voltage applied to the varistor 21 also remains smaller. Accordingly, the current I2 will not flow from the varistor 21 toward the second series circuit 12 (pincushion magnetic field production coil sections 6, 8) as in the prior art, while the current I2 ($I2 \cong I$) flows only in the first series circuit 11 (barrel magnetic field production coil sections 5, 7), thereby enabling the resulting vertical deflection magnetic field to behave as the barrel magnetic field. It is thus possible to attain successful correction of the misconvergence S3V shown in FIG. 7.

Figure 6:
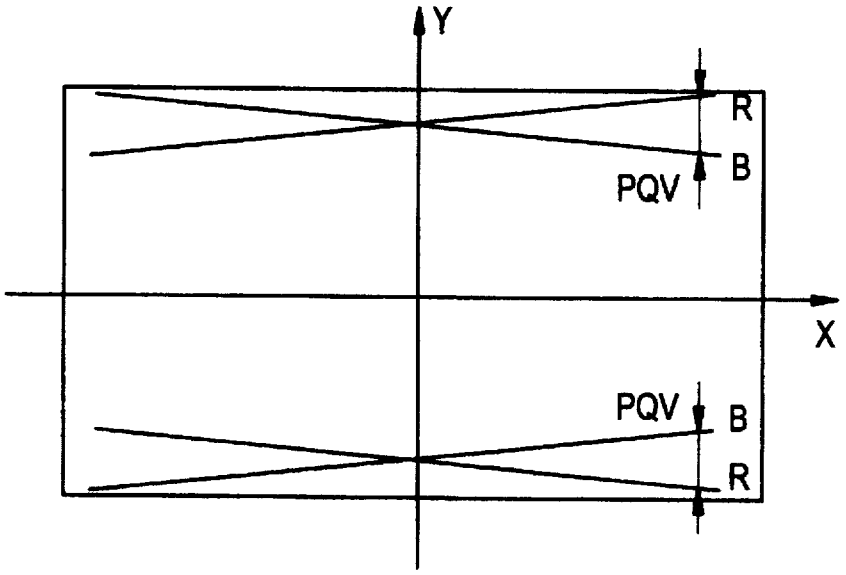
FIG. 6 illustrates a pattern of cross-misconvergence PQV as generated on a display screen of a three-gun color picture tube using the deflection yoke.

Alternatively, imagine that the vertical deflection current I increases, that is, the electron beams are scanning the upper and lower peripheral regions, or nearby regions, of the display screen as expanded in the vertical direction thereof. Under these circumstances, the voltage applied to the varistor 21 is potentially increased accordingly. This results in an increase in the current I2 flowing from the varistor 21 toward the second series circuit 12, while the current I1 is decreased which flows into the first series circuit 11 which is connected in parallel to the second series circuit 12. This may serve to cause the vertical deflection magnetic field to enhance the nature of the pincushion magnetic field, thereby to correct the cross-misconvergence PQV shown in FIG. 6.

Accordingly, with the first preferred embodiment, it becomes possible to effectively control and adjust the current I2 flowing into the second series circuit 12 (pincushion magnetic field production coil sections 6, 8) which is series-connected to the varistor 21, depending upon the actual magnitude of the vertical deflection current I due to the fact that the prior art diodes 13, 14 are replaced with the varistor 21 which may vary in resistance with potential variations of the applied voltage, and which is specifically connected between the second series circuit 12 and the low-voltage terminal. Consequently, the vertical deflection magnetic field produced by the vertical deflection coils 3 is capable of changing gradually in nature from the barrel magnetic field to the pincushion magnetic field as the vertical deflection current varies. This makes it possible for the vertical deflection magnetic field to act as the barrel magnetic field in the vertically centered region of the display screen and to enhance the nature of pincushion magnetic field as it moves far from the center region to expand approaching the upper and lower peripheral display regions.

As a consequence, the preferred embodiment is capable of eliminating the occurrence of any rapid change or switching of the vertical deflection magnetic field in nature from the barrel to the pincushion magnetic field, which in turn enables an undesired pattern of white lines (white rasters) to appear at the border lines whereat the vertical deflection magnetic field is to rapidly switch from the barrel to the pincushion magnetic field on the display screen due to switching operations of diodes 13, 14 in the conventional deflection yoke mentioned previously. Elimination of such rapid magnetic-field change achieves successful correction of both the cross-misconvergence PQV and the misconvergence S3V on the display screen of the color picture tube of television receivers, and achieves almost complete removal of white rasters on the display screen, whereby the quality of the resultant color pictures thereon can be greatly improved.

Another significant advantage of the deflection yoke embodying the preferred embodiments of the present invention is that, since the diodes 13, 14 required in the prior art devices are not required in the preferred embodiments of the present invention, the use of the diode control resistor 18 associated therewith is also unnecessary thereby causing the number of required components or parts to decrease. This simplifies the entire structure of the deflection yoke and reduces the manufacturing cost accordingly.

Figure 3:
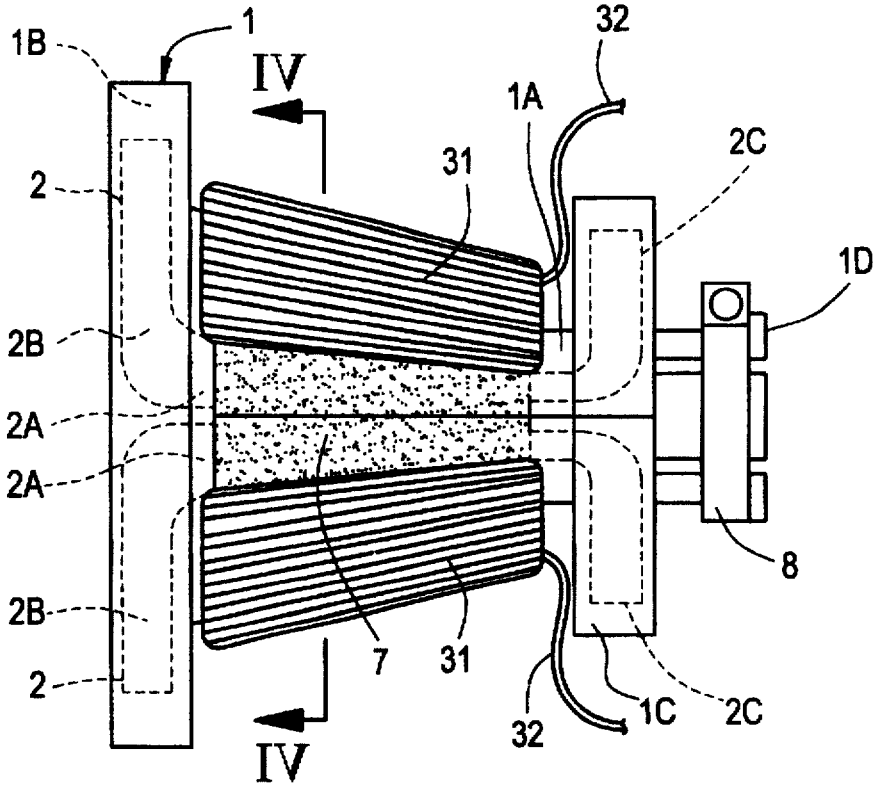
FIG. 3 shows a side view of a saddle-toroidal deflection yoke in accordance with another preferred embodiment of the invention.
Figure 4:
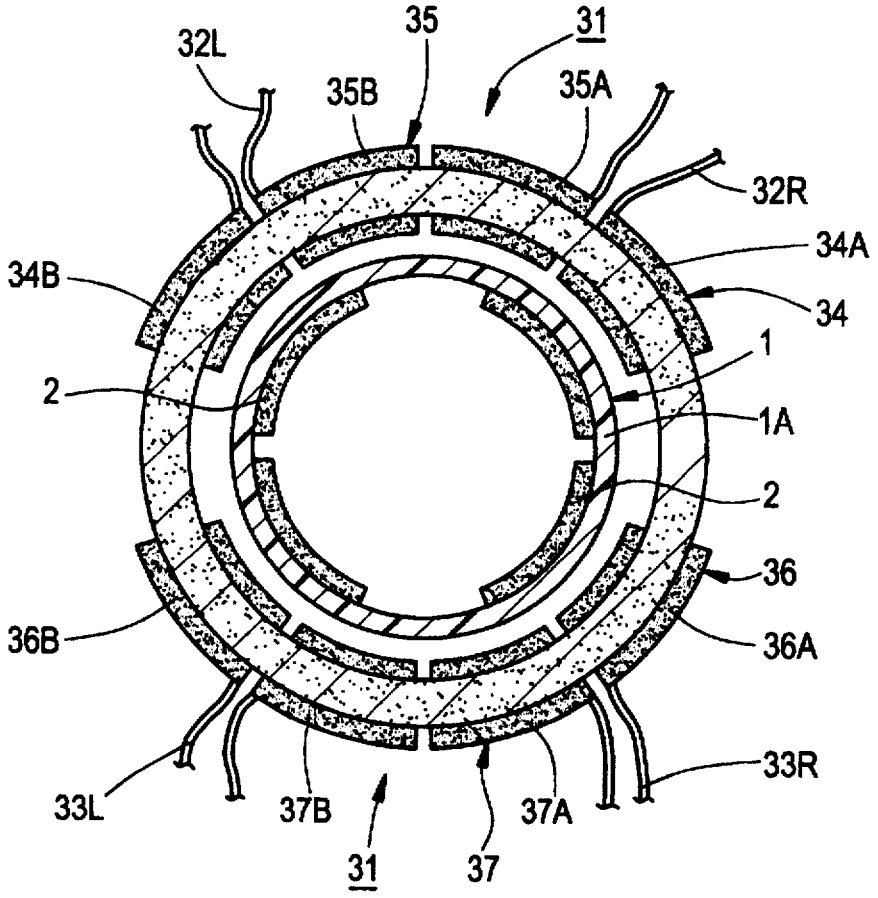
FIG. 4 is a cross-sectional view of the deflection yoke taken at line IV—IV of FIG. 3.
Figure 5:
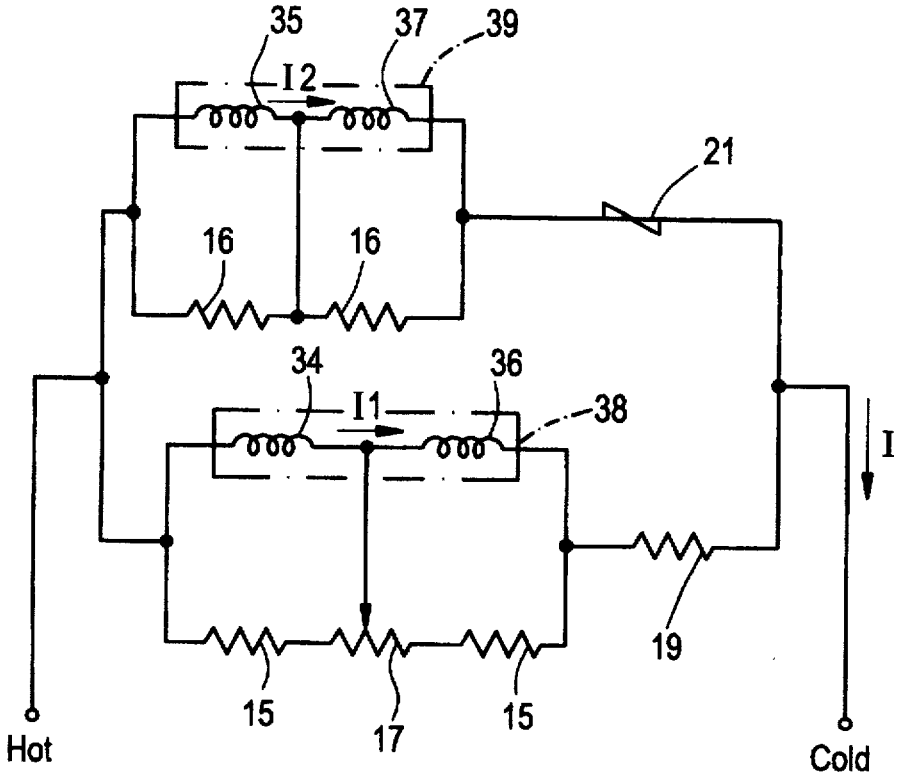
FIG. 5 is a circuit diagram showing a configuration of e deflection yoke shown in FIGS. 3 and 4.

A deflection yoke device in accordance with a second preferred embodiment of the invention is shown in FIGS. 3 to 5. This preferred embodiment includes a deflection yoke that is of the "saddle-toroidal (ST)" type with the windings turned around a core into a saddle-toroidal form. Note that like parts or components are designated by like reference characters used in the first preferred embodiment, and detailed description of like parts therefor will be omitted herein.

As shown in FIG. 3, toroidal vertical deflection coils 31 are disposed at the upper and lower positions of the core (not depicted in FIG. 3, but designated by numeral 9 in FIG. 8) as a result of windings turned around it to define the toroidal shape.

As shown in FIG. 4, a plurality of lead wire pairs 32R, 32L, 33R, 33L are provided and extend out from selected midway portions of the windings turned around the vertical deflection coils 31. Of these lead wires 32R–33L, the upper lead wires 32R, 32L connected to the corresponding upper vertical deflection coil 31 serve to divide this deflection coil into a barrel magnetic field production coil section 34 and a pincushion magnetic field production coil section 35, whereas the remaining lead wires 33R, 33L coupled to the lower vertical deflection coil 31 divides the coil 31 into a barrel magnetic field production coil section 36 and a pincushion magnetic field production coil section 37.

As can be readily seen from FIG. 4, the barrel and pincushion magnetic field production coil sections 34, 35 as formed by the upper vertical deflection coil 31 are specifically arranged in such a manner that the barrel magnetic field production coil section 34 may correspond to the part of the windings that extends from respective terminal ends (not shown) of the horizontal axis-side windings of the upper vertical deflection coil 31 up to the lead wires 32R, 32L, which part comprises a winding section 34A located at the upper right section and a winding section 34B located at the upper left section. On the other hand, the pincushion magnetic field production coil section 35 corresponds to a part of the windings that extends from the lead wires 32R, 32L of the upper vertical deflection coil 31 to respective terminal ends of the vertical axis-side windings, which includes a winding section 35A located at the upper right section and a winding section 35B at the upper left section.

In the cross-section structure of FIG. 4, the barrel and pincushion magnetic field production coil sections 36, 37 formed by the lower vertical deflection coil 31 are arranged such that the barrel magnetic field production coil section 36 corresponds to a part of the windings that extends from respective terminal ends (not shown) of the horizontal axis-side windings of the lower vertical deflection coil 31 to the lead wires 33R, 33L, which part comprises a winding section 36A located at the lower right section and a winding section 36B located at the lower left section. The pincushion magnetic field production coil section 37 corresponds to another part of the windings extending from the lead wires 33R, 33L of the lower vertical deflection coil 31 to respective terminal ends of the vertical axis-side windings, which is comprised of a winding section 37A located at the lower right section and a winding section 37B located at the lower left section.

Upon application of the vertical deflection current to the barrel magnetic field production coil sections 34, 36, a barrel magnetic field is created within the coil bobbin 1; and, when the vertical deflection current is fed to the pincushion magnetic field production coil sections 35, 37, a pincushion magnetic field is produced in the interior of the coil bobbin 1.

A circuit configuration of the coil sections 34–37 is shown in FIG. 5, wherein the upper and lower barrel magnetic field production coil sections 34, 36 are connected in series to each other to form a first series circuit 38, whereas the upper and lower pincushion magnetic field production coil sections 35, 37 are connected in series to each other to define a second series circuit 39. The first and second series circuits 38, 39 are connected in parallel with each other, and are further connected between the high-voltage terminal (Hot terminal) and low-voltage terminal (Cold terminal) which are operatively coupled to a known vertical deflection current generator circuit.

In the deflection yoke in accordance with the second preferred embodiment, each vertical deflection coil 31 has the windings turned around the core 9 into the toroidal shape. The operations of this preferred embodiment are similar to those of the first preferred embodiment in that the varistor 21 operates depending upon the actual magnitude of the vertical deflection current thus providing suitable adjustment of currents flowing in the first and second series circuits 38, 39.

Accordingly, when the vertical deflection current remains small, that is, when the electron beams are scanning the center region of the display screen in the vertical direction thereof, the current I2 flowing in the second series circuit 39 (pincushion magnetic filed production coil sections 35, 37) is rendered smaller while allowing the current I1 flowing into the first series circuit 38 (barrel magnetic field production coil sections 34, 36) to increase, thereby causing the resulting vertical deflection magnetic field to behave as a barrel magnetic field.

Alternatively, when the vertical deflection current increases, that is, when the electron beams are scanning both peripheral display regions in the vertical direction, the current I2 flowing in the second series circuit 39 (pincushion magnetic filed production coil sections 35, 37) can be increased while forcing the current Ii flowing into the first series circuit 38 (barrel magnetic field production coil sections 34, 36) to decrease, thereby causing the vertical deflection magnetic field to resemble a pincushion magnetic field.

With the second preferred embodiment also, it is possible for the vertical deflection magnetic field produced by each vertical deflection coil 31 to gradually change in nature from the barrel to the pincushion magnetic field. This can eliminate white rasters which appear on the display screen in the prior art, while providing optimal corrections of the cross-misconvergence PQV and misconvergence S3V.

While the invention has been particularly shown and described with reference to preferred embodiments thereof, it will be understood by those skilled in the art that the foregoing and other changes in form and details may be made therein without departing from the spirit and scope of the invention. For instance, with the illustrative preferred embodiments, the varistor 21 is connected in series to the second series circuit 12 (39). However, the invention should not be limited exclusively to such an arrangement; the varistor 21 may alternatively be connected in series to the first series circuit 11 (38). In this case, the vertical deflection magnetic field becomes a pincushion magnetic field at or near the center of the display screen in the vertical direction thereof, and is transformed into a barrel magnetic field as it vertically expands to approach the both peripheral display regions. Additionally, while the embodiments assume the use of the SS and ST deflection yokes, the invention is not limited to such kinds of yokes. Any kind of yoke may alternatively be employed, including a saddle-saddle-toroidal (SST) deflection yoke.

What is claimed is:

1. A deflection yoke device comprising:

a coil bobbin for being placed around a neck of a color picture tube of television receivers;

a combination of a horizontal deflection coil pair and a vertical deflection coil pair for producing a magnetic field for deflection of one or several electron beams from the neck of the color picture tube;

said vertical deflection coil pair being divided into a plurality of barrel magnetic field production coil sections and a plurality of pincushion magnetic field production sections;

said barrel magnetic field production coil sections being connected in series to each other to provide a first series circuit;

said pincushion magnetic field production coil section being connected in series to each other to provide a second series circuit which is connected in parallel with said first series circuit; and a voltage-dependent variable resistor connected in series to one of the first and second series circuits.

2. A deflection yoke device comprising:

a coil bobbin for being placed around a neck of a color picture tube;

an assembly of a horizontal deflection coil pair and a vertical deflection coil pair for producing a magnetic field for deflection of one or several electron beams from the neck of the color picture tube;

said vertical deflection coil pair being divided into a first series combination of barrel magnetic field production coil sections and a second series combination of pincushion magnetic field production sections; and a current control device connected in series to one of the first and second series combinations and including a resistive element including a varistor and having a resistance which varies with variations of a voltage applied thereto for forcing current flowing therein to change with variations in vertical deflection current supplied to said vertical deflection coil pair.

3. The device of claim 2, wherein said current control device prevents current to flow into said one of said first and second series combinations associated therewith when the vertical deflection current is less than a predefined level.

4. The device of claim 3, wherein said current control device allows current to flow in said one of said first and second series combinations when the vertical deflection current is greater than the predefined level while permitting flow of current in the other of said first and second combinations.

5. The device of claim 4, wherein when the vertical deflection current is greater than the predetermined level, said current control device allows the current flowing in said one of said first and second combinations to gradually increase as the vertical deflection current increases.

* * * * *